United States Patent [19]

Wilson

[11] Patent Number: 4,570,692

[45] Date of Patent: Feb. 18, 1986

[54] METHODS OF POURING METAL

[76] Inventor: William G. Wilson, 820 Harden Dr., Pittsburgh, Pa. 15229

[21] Appl. No.: 203,315

[22] Filed: Nov. 3, 1980

[51] Int. Cl.[4] ..... B22D 27/00

[52] U.S. Cl. ..... 164/56.1; 164/57.1; 75/58

[58] Field of Search ..... 164/55.1, 56.1, 57.1; 75/53, 58

[56] References Cited

U.S. PATENT DOCUMENTS

| | | | |
|---|---|---|---|
| 1,184,523 | 5/1916 | Field | 164/57.1 |
| 4,069,859 | 1/1978 | Nagai et al. | 164/56.1 |

FOREIGN PATENT DOCUMENTS

| | | | |
|---|---|---|---|
| 3739 | 2/1975 | Japan | 164/57.1 |
| 1116591 | 6/1968 | United Kingdom | 164/57.1 |

*Primary Examiner*—Nicholas P. Godici

*Attorney, Agent, or Firm*—Buell, Ziesenheim, Beck & Alstadt

[57] ABSTRACT

A method of pouring metal to provide improved physical properties is provided including the steps of: (a) pouring the metal through a generally vertical consumable tube extending from a pouring source to a point submerged beneath the surface of a molten pool in the receptacle, (b) continuously consuming the end of said vertical tube submerged beneath the surface of the molten pool to maintain a generally uniform portion of tube end submerged in said molten pool as pouring progresses of sufficient length to provide stirring action across substantially the full top area and to prevent the metal from flowing across the top surface as a flowing layer; and (c) removing said tube when pouring into the receptacle is completed. Slag components and/or alloy components are introduced into the metal in the tube to react with the metal.

8 Claims, 11 Drawing Figures

METHODS OF POURING METAL

This invention relates to methods of pouring metal and particularly to a method of teeming to produce ingots of superior cleanliness and freedom from large inclusions.

It has been recently recognized that stirring is the most important tool in steelmaking. The forced stirring of molten metal provides rapid and efficient slag-bath reactions, homogenization of the molten metal and improved removal of non-steel components with a consequent reduction in non-metallic inclusions in the final solidified metal. Two methods of stirring have been generally used in the steel industry. One method is based upon induction stirring using electrical induction currents to cause circulation or stirring of the metal. The second method is by the use of a carrier gas with Ca-metal particles carried into the metal to evaporate or other metals that evaporate at steel making temperature and cause bubbles along with the flowing carrier gas. No other methods has to my knowledge proven successful.

It is known that, when an ingot mold or a ladle is filled with steel from a nozzle above the receptacle, the stream of molten metal will penetrate partly into the steel already in the receptacle and will then move upwardly and outwardly until it strikes the wall of the receptacle and then will proceed down along the wall of the receptacle for some distance and then turn toward the center of the receptacle. The energy of the molten stream varies within the receptacle as it fills. At the beginning, the drop from the nozzle to the bottom of the receptacle is greatest and the amount of metal being stirred is at a minimum. Stirring is most violent at this point. On the other hand, when the receptacle is almost full the drop from the nozzle has been drastically reduced and the amount of metal being stirred is large. At this point the stirring of the metal is much less than at the beginning of the pouring operation. Another serious drawback to conventional practice is the splashing of metal onto the receptacle walls, causing scabs and other surface defects. Accordingly, the effectiveness of conventional pouring as a stirring tool has been discounted as being unsatisfactory because of the wide fluctuation of stirring effectiveness from start to finish and the accompanying physical problems.

I have discovered that pouring of molten metal can be made a most effective means for stirring, introducing of additives and for general control of final steel or metal quality.

I provide a method of pouring in which the poured or teemed stream of molten metal is confined with a consumable tube inserted in the receiving receptacle and said tube is consumed in the metal in the receptacle as the metal rises therein at a controlled rate so that the discharge end of the tube remains at a substantially constant level below the top surface of the metal in the bath as the receptacle fills. Preferably, the tube is made of a metal of the same composition or a composition compatable with the metal being poured. It is essential that the tube be formed so that the end of the tube always remains at a substantially constant level below the top surface of the bath of molten metal which is sufficient to provide a stirring action across substantially the full top area and to prevent the metal from flowing across the top surface in the conventional flow pattern of conventionally teemed steel. This stirring action is of substantially uniform depth across the metal bath. Slag and/or alloy additions are introduced into the tube to be carried by the flowing molten metal and stirred into the bath. Preferably, the added slag components are those which will provide additional refining and will reduce the melting point of the slag such as $Al_2O_3$, $Ce_2O_3$, $CaF_2$ or halogen salts. Those alloys which are preferably added by my practice are those which are most reactive such as aluminum, titanium, zirconium, magnesium, calcium or rare earths.

The practice of my invention provides many advantages over present practices. The stirring energy of the teeming stream of molten metal remains substantially constant throughout the pouring period and the conventional flow pattern across the top of the metal in the receptacle is eliminated. Since the length of the tube below the surface of the molten metal remains substantially constant, the volume of metal stirred is substantially constant throughout the pouring period. When a slag forming material is added with the poured metal and its composition is properly chosen, it can add both surface protection and refining to the metal as well as forming a thin film of slag coating between the receptacle wall and molten metal that provides a surface on the solidified metal, that is essentially free of defects such as scabs, cracks, etc., ordinarily formed on ingot surfaces of conventionally poured ingots. In addition, the covering of the metal surface outside the pour tube with molten slag reduces the oxygen content in the metal being poured to a lower level than can be achieved by conventional pouring. This in turn results in fewer inclusions and a reduced length of inclusions in the final product. The practice of my invention significantly reduces the detrimental effects of reoxidation during teeming of steels containing strong deoxidizers which would occur by conventional pouring practice.

In the foregoing general description of my invention I have set out certain objects, purposes and advantages of this invention. Other objects, purposes and advantages of this invention will be apparent from a consideration of the following description and the accompanying drawings in which:

FIG. 1 is a schematic flow pattern of conventionally teemed steel from a paper by G. J. Roe & B. L. Bramfitt entitled "Modeling of Ingot Teeming" *Proceedings of Electric Furnace Conf.* Vol. 36, 1978;

FIG. 2 is a graph of average inclusion length vs CVN values;

FIGS. 3*a* and 3*b* are photographs of split ingots showing the reoxidation of rare earth treated steels with and without the protection of the present invention;

Figure 1:
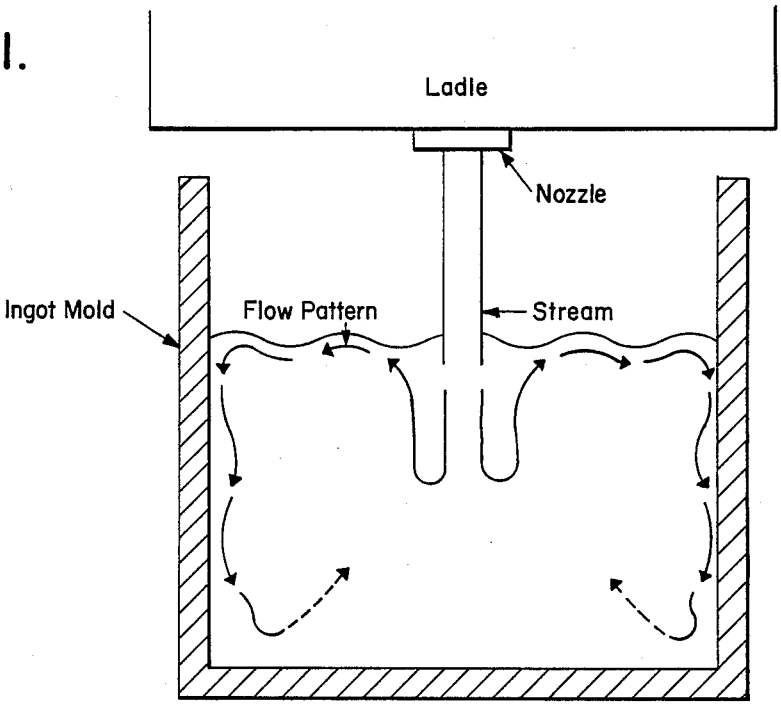

Referring to the drawings I have shown in FIG. 1, taken from a paper by G. J. Roe & B. L. Bramfitt, "Modeling of Ingot Teeming" *Proceedings of Electric Furnace Conf.*, V. 36, 1978, schematically the flow patterns that exist when an ingot mold is filled with steel. The stream from the ladle flows into the steel that is in the mold and penetrates partially into the steel already in the mold. The flow pattern illustrated then moves upwardly and toward the side of the mold, then continues down the side of the mold for a considerable distance before it reverses direction and comes in toward the center of the mold. The energy of the teeming stream as it leaves the nozzle remains almost constant during the filling of any one mold. However, the energy of the stream varies widely in the mold as the mold fills. When the mold starts to fill, the drop from the ladle to the steel level in the mold is greatest (maximum energy input) and the amount of metal being stirred is minimum. Therefore, stirring is most violent at this point. However, when the ingot is almost full as illustrated in FIG. 1 the height of the fall from the ladle to the surface of the metal has been reduced (the stirring energy is smaller) and the amount of metal being stirred is much larger. The stirring in the mold at this point is much less than when the pouring of the ingot was begun.

It is one of the novel features of this invention that the stirring energy of this teeming stream remains almost constant throughout the teeming of an ingot when a tube of metal compatible with the metal being poured is inserted into the mold and the metal is poured through this tube. The tube eliminates the flow pattern across the top surface of the ingot and concentrates this energy within the tube. The length of the tube in the molten metal is automatically controlled by the rate at which the tube melts as the molten metal rises in the mold so that the volume of metal stirred remains essentially constant. This constant stirring energy can then be used to stir a slag addition made into the tube with the metal in such a manner that sufficient heat is transferred from the metal to the slag to fuse the slag. If slag is added in sufficient quantity throughout the teeming of the metal, the metal stream can always be poured through a refining slag that would be most advantageous for the metal being poured. However, such a slag would be effective even if it were added in its entirety early in the teeming of the ingot. In most cases this would be a low melting point slag composed of stable oxides (those with large negative free energies of formation) such as CaO, $Al_2O_3$, $Ce_2O_3$ etc. and some flux such as calcium fluoride ($CaF_2$) or some other salt containing one of the halogens (chlorine, fluorine, iodine, etc.) that can reduce the melting point of the slag to a temperature such that it can be fused easily when stirred with the molten teeming stream.

A portion of the molten slag in the tube is entrapped by the teeming stream and carried past the bottom of the tube after which it floats to the surface of the metal in the mold. If the composition of the slag is carefully chosen, a portion of the slag will solidify at the periphery of the meniscus of the metal as it rises in the mold leaving a thin coating of slag between the metal and the mold that creates a surface on the solidified ingot. The surface so created is essentially free of the defects such as scabs, cracks, etc., ordinarily found on ingot surfaces of conventionally poured metals.

Figure 2:
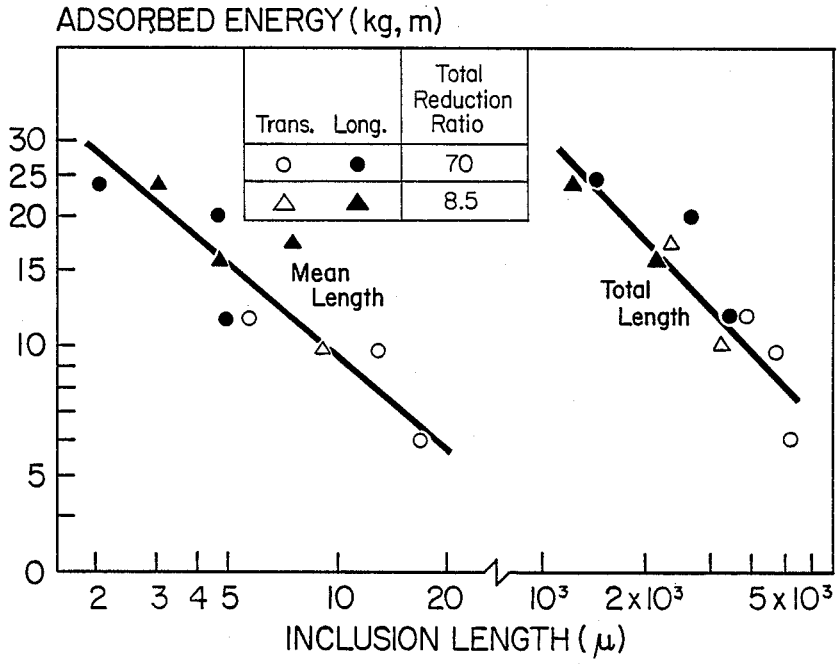

Alloys can be added with the slag throughout the teeming of the metal in sizes that are a maximum of about two inches in any dimension and that are compatible with the system used for adding the slags or they may be added separately. Because of the stirring action of the metal in the tube and the resultant flow pattern in the mold, those alloy additions may be added in the early part of the teeming operation and good distribution throughout the entire ingot can be expected. When the stability of the oxides in the slags is high, even the most reactive alloys such as aluminum, titanium, zirconium, magnesum, calcium or rare earths and the like will be transferred to the steel from the slag with maximum retention of the alloying element in the metal being teemed. The addition of these alloys along with these stable oxides that will not react with these alloying elements, the elimination of the flow pattern across the surface of the mold, and the covering of the metal surface outside of the tube with the molten slag carried by the teeming stream under the bottom of the tube, reduces the oxygen content in the metal being poured to a lower level than can be achieved with conventional pourings. This in turn results in fewer inclusions of smaller size remaining in the metal. I have found that the ductility of steel as typically measured by Charpy V Notch (CVN) test results can be improved when the average size of the inclusions in the metal is reduced. This relationship between average inclusion length and CVN values is shown in FIG. 2.

Figure 3:
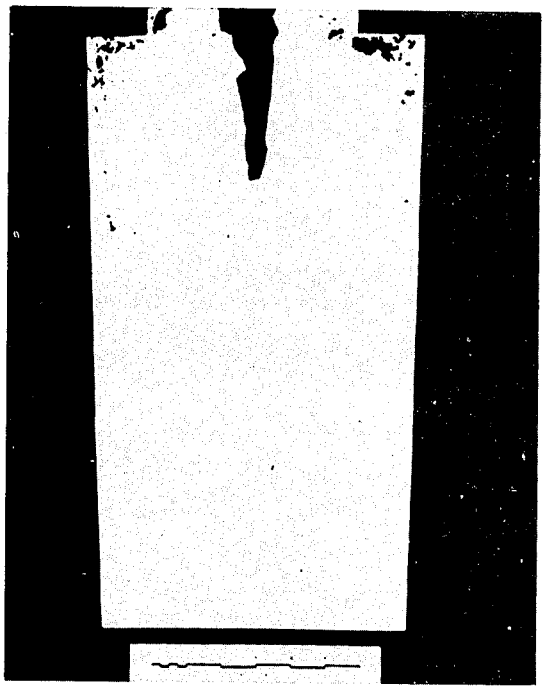
Figure 3A:
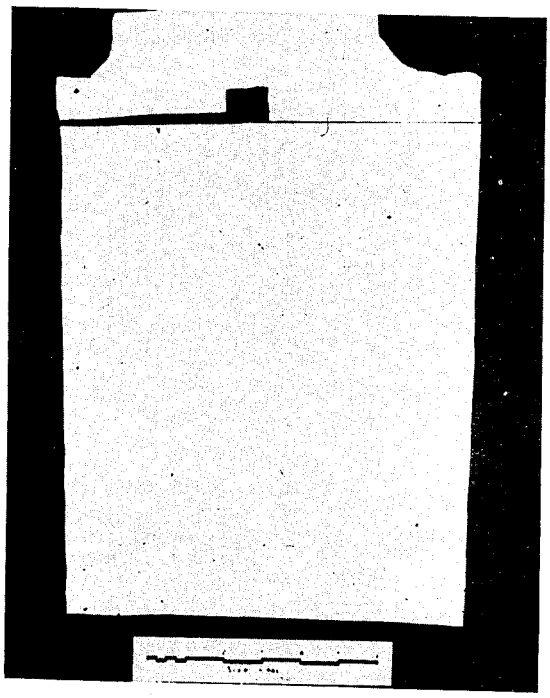

Recent technical literature has discussed the detrimental effects of reoxidation during teeming of steels that contain strong deoxidizers. This is a well recognized problem. A typical example of the detrimental effects of reoxidation is shown in FIG. 3. At the top of the ingot close to the hot top there is a collection of large inclusions. When the tests taken from such a steel contain a significant portion of these large inclusions, the ductility of the steel will be adversely affected.

Techniques have been developed to determine statistically the size of inclusions found in an ingot use the following described technique. A longitudinal sample from the steel is examined under the microscope. In an area 10 $mm^2$ of the polished sample, the thirty largest inclusions are measured at a magnification of 400× and their length recorded. Those data are then plotted on arithmetic probability graph paper which has a linear scale on the ordinate or Y axis, and a cumulative frequency scale on the abscissa or X axis. Thus data that exhibits a normal "bell shaped" frequency distribution will fall on a straight line when plotted on this type of paper.

Figure 4:
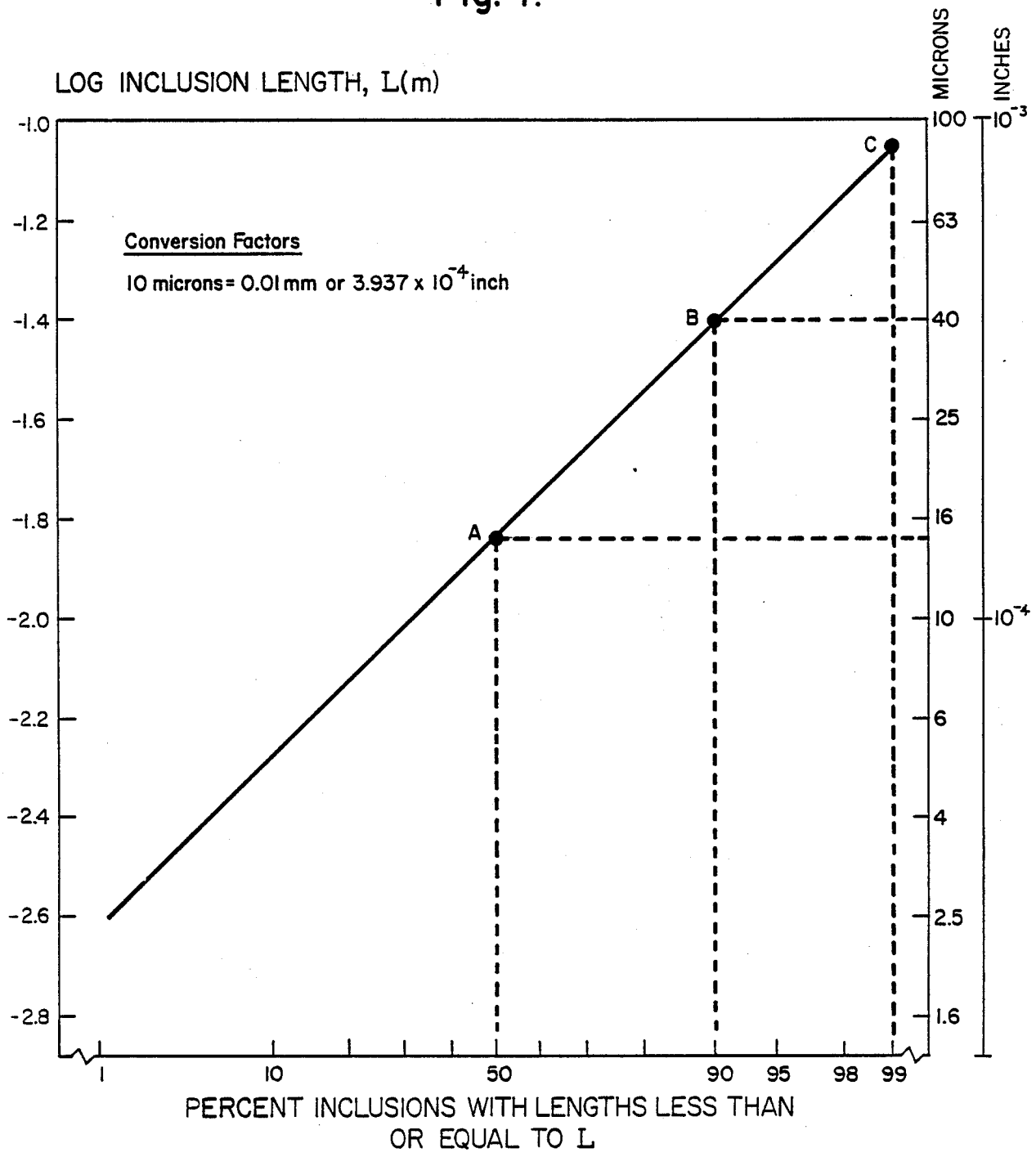
FIG. 4 is a typical curve of inclusion measurements.

A typical curve showing this method for handling inclusion measurements is shown in FIG. 4. The data shown in FIG. 4 may be interpreted in the following manner. Fifty percent of the inclusions found in this sample have actual lengths less than 15 microns and 95% of the inclusions have lengths less than or equal to 80 microns.

The novel characteristics of this invention can be illustrated with such measurements. Steels containing rare earths, which are very strong deoxidizers, have been illustrated in FIG. 3 to be subject to reoxidation with the large inclusions shown in FIG. 3 resulting. The beneficial effect of the novel characteristics described in the teachings of this invention are illustrated in Table I.

TABLE I

| | Tube Used | | | 50% | | 95% | |
|---|---|---|---|---|---|---|---|
| Practice | According to Invention | Slag Added In Mold | RE Added In Mold | Inclusion Top | Length Bottom | Inclusion Top | Length Bottom |
| Misch Metal | No | No | No | 8 | 10 | 16.3(1) | 15.0 |

TABLE I-continued

| Practice | Tube Used According to Invention | Slag Added In Mold | RE Added In Mold | 50% Inclusion Top | 50% Length Bottom | 95% Inclusion Top | 95% Length Bottom |
|---|---|---|---|---|---|---|---|
| Add'n. to Ladle Slage Addition Only | Yes | Yes 2#/Ton | No | 5 | 4.5 | 14.4 | 22.9 |
| Slag + RE Silicide | Yes | Yes 2#/Ton | Yes 1#/Ton | 3.2 | 3.5 | 7.1 | 6.5 |

(1)Occasional inclusions several fields of the microscope in length at 400× which are probably due to reoxidation as shown in FIG. 3.

Referring again to FIG. 2 reductions in inclusion lengths of the order shown in the Table I of the mean inclusion length (50%) in linepipe steel of 70 Ksi yield strength, could result in the CVN energy almost doubling when the average inclusion length was reduced from 10 microns to 3.3 microns.

Figure 5:
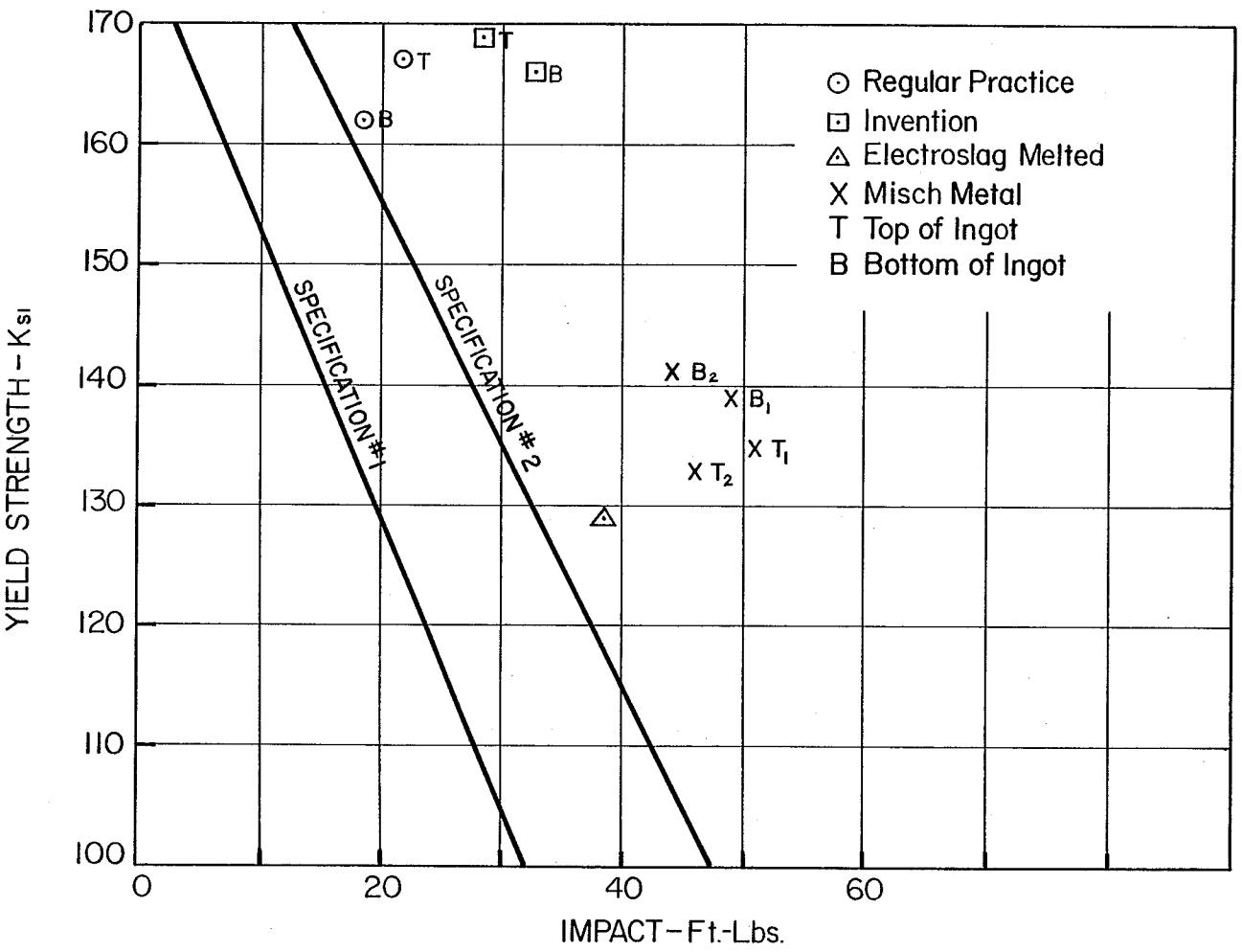
FIG. 5 is a graph of two U.S. Army specifications for yield strength vs CVN results.

In steel similar to the SAE 4340 steels used for this study, the U.S. Army has specifications wherein the CVN energy decreases as the strength increases. Two such specifications are plotted in FIG. 5. Also plotted are the results from trials showing CVN results from an ingot of steel produced from the same heat to which neither slag additions nor slag plus rare earth additions were made to the mold. A further comparison is made with data from SAE 4340 steel electro slag remelted (ESR) ingots recently reported in "Cast Gun Tubes by Electro Slag Refining", H. J. Wagner and K. Bar Avi, *Metals Technology,* November, 1979. ESR melting is reputed to produce steels that are cleaner than those produced by any other method with the exception of those that are vacuum arc remelted. Also shown are values from a steel according to the invention with slag alone and rare earth additions and two steels with misch metal addition, all of the SAE 4340 composition.

As can be seen, the impact requirements at any strength level for Specification #1 are much less demanding than those for Specification #2. Also, note how rapidly the required CVN values decrease as the strength increases.

The heat to which misch metal alone (MM) was added, and the steel that was melted with the ESR method are heat treated to the lowest strength levels, and the impact values of the two MM ingots exceed those of the ESR ingots. The MM heat has CVN value almost double those required in the specification.

The CVN values for the ingot with no mold additions and mold additions of slag and slag and rare earth metal are made from steels heat treated to a much higher strength level than the heat to which the MM was added and ESR melted steels.

The best impact values are those obtained on the top and bottom of the ingot with the slag (S) and rare earth (R) additions (SR), these CVN values average about 30 ft. lbs. and the specification calls for 14 ft. lbs. at this strength level. Average inclusion lengths of about 3.5 microns measured in these steels would have indicated their superb performance. The top and bottom tests on the ingot with the slag additions average about 23 ft. lbs., 53% in excess of the most difficult CVN specification at that strength level. Finally, the control ingot without any mold additions averages about 20 ft. lbs., the lowest CVN energy of the three ingots tested.

Figure 6:
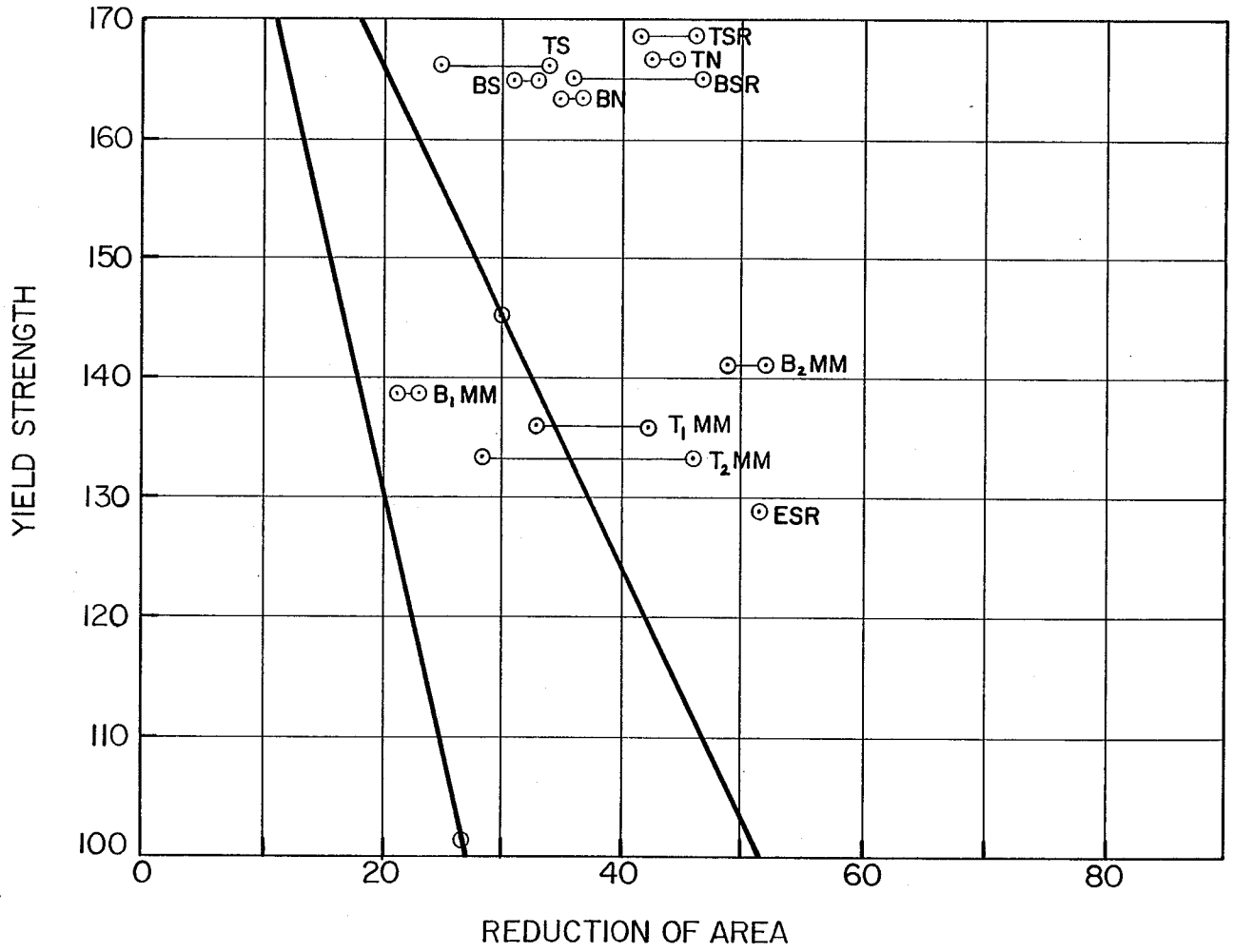
FIG. 6 is a graph of reduction of area versus yield strength for the two U.S. Army specifications of FIG. 5.
Figure 7A:
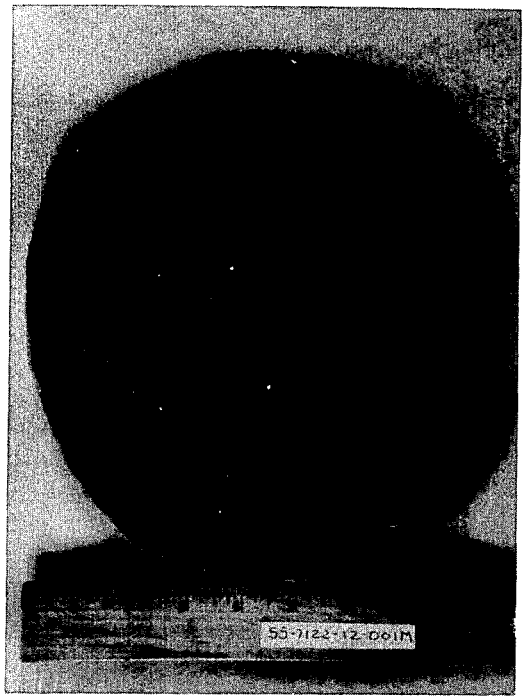
FIGS. 7*a* through 7*d* are photomicrographs of macroetch discs from the top and bottom of two ingots, one treated with slag and rare earths by the practice of this invention and the other treated with slag only.
Figure 7C:
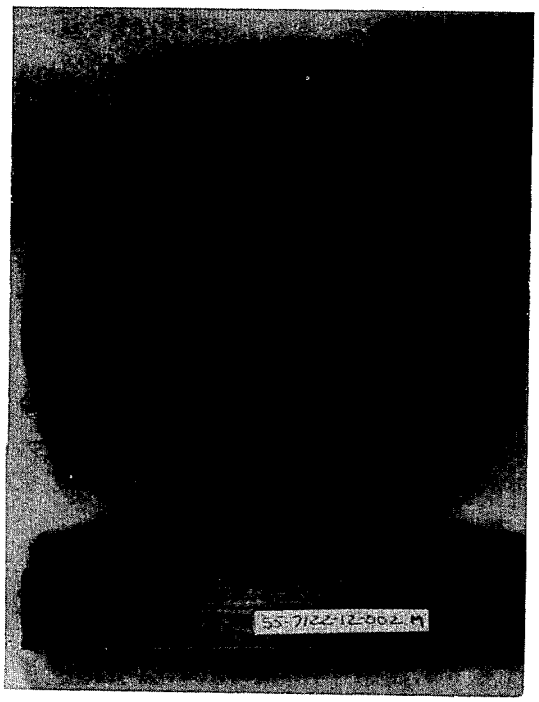
Figure 7B:
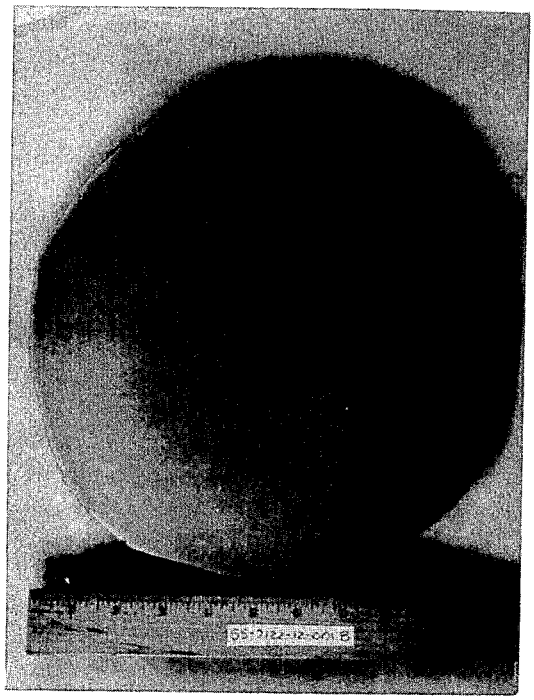
Figure 7D:
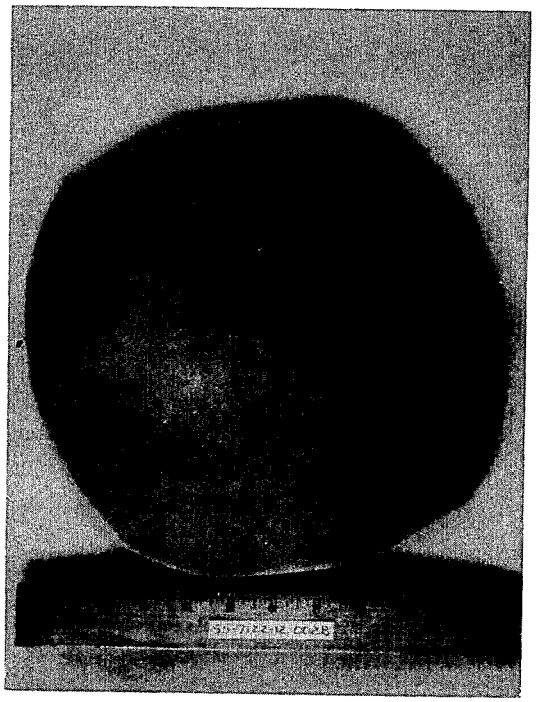

These military specifications also contain a requirement to meet certain reduction of area values. These reduction of area values required for Specification #1 and Specification #2 are shown again, as a function of the yield strength of the steel in FIG. 6. In Table I it was noted that there were occasional inclusions that were several fields long at 400×. These inclusions did not seem to interfer with the impact values but they have drastically reduced the reduction of area values to below those acceptable for the most difficult Specification #2.

Again the 95% inclusion length (22.9 microns) of those found in the ingot with slag only has lowered the reduction of area value to 22% whereas the reduction of area of the steel from the ingot with slag and rare earths is 32% at the bottom of the ingot.

Further evidence of the deoxidizers power of these slags and the effect of strong sulfide shape control elements, all of which are strong deoxidizers, can be illustrated by the oxygen and rare earth analysis of samples taken from the forged ingot treated with both slag and rare earths. These analyses are shown in Table II.

TABLE II

| | RE Added | RE Retained | Possible Oxygen Removed 2 (RE) +30 $RE_2O_3$ (42 ppm) | Oxygen Content | Oxygen Removed |
|---|---|---|---|---|---|
| Ingot without any addition | — | — | — | 105 | |
| Ingot according to invention with Slag and Rare Earth | 0.0475% | 0.023% | .0042% | 61 | 44 ppm |

The combination of slag and rare earth additions can prevent reoxidation during teeming allow the rare earths present to react with oxygen in the steel with almost complete efficiency as demonstrated by the results shown in Table II.

When the ingots of SAE 4340, to which slag additions and slag and rare earth additions were made were taken from the mold into which they were teemed, their surfaces were covered with a thin coating of slag which fell off the ingot quickly after it was removed from the mold. The surfaces showed no cracks and there were no traces of the surface irregularities resulting from the splashing that occurs from the teeming stream striking the metal in the mold and that solidify on the mold wall and which eventually appear on the ingot surface in conventional practices. These irregularities are commonly referred to as "scabs". Pictures of the macroetch discs taken from the top and bottom of the ingot to which both slag and rare earths were added are shown to illustrate this absence of cracks on the surface which would have been visible on these macroetches. These macroetches also indicate the absence of subsurface inclusions of any kind. This is in contrast to the case of the macroetches from the conventionally treated heat in which misch metal was added to the ladle which were not only deficient in tensile reduction of area but also show obvious clusters of inclusions in the macroetches that resulted in that heat being rejected for a demanding application.

The improvements in cleanliness as shown by inclusion length determinations and macroetch quality with slag additions or slag and rare earth additions according to this invention were achieved with slag additions of two pounds per ton of slag and slightly less than one pound per ton of rare earths. There is nothing in this evidence that indicates that much larger additions of slag up to as much as one percent of the metal weight might not be more effective than the amount of slag used in these two ingots. In electro slag remelting (ESR) slag quantities of one percent and greater of the steel weight have been shown to be capable of desulfurizing and dephosphorizing ESR melted steels. The very modest additions of slags used in these trials were insufficient to desulfurize or dephosphorize to a measurable amount.

Further, the amount of rare earths added can be increased beyond the one pound per ton used in this example and existing thermodynamic data indicates that these increased additions of rare earths that the steel would have lower oxygen, lower sulfur and the formation of high melting point compounds with lead, arsenic, antimony and phosphorous would be expected.

Rare earths are not the only elements that may be added to achieve the benefits described above. Some of the other strong deoxidizers and sulfide shape controlling elements such as calcium, titanium, zirconium and magnesium may also be used. Although aluminum is not a sulfide former, it can be used to reduce the oxygen content of the system to such low levels that the slags can better desulfurize and dephosphorize.

The composition of the slag used in these two ingots was 40% CaO, 30% $CaF_2$ and 30% $Al_2O_3$. Slags made from other combinations from the group $CaO$-$CaF_2$-$Al_2O_3$ may be equally effective. Generally the benefits will be greatest when the $Al_2O_3$ is at a minimum necessary to rapidly flux the slag as it is stirred with the metal in the tube by the teeming stream. Silica, ($SiO_2$), can be used to replace a part of either the $Al_2O_3$ or $CaF_2$ to reduce the melting points of these slags even so far as to the exclusion of the $Al_2O_3$, but because the chemical stability of silica is less than $Al_2O_3$, the use of $SiO_2$ in those slags could reduce their ability to produce the changes shown previously in this disclosure and therefore must be used with care.

The concept of this invention illustrated above by the additions of slag and of slag and rare earths when added in a tube in the mold through which the ingot is being teemed can be used when tapping a furnace into a ladle. When a top blown or bottom blown basic oxygen furnace (BOF) or (QBOF) is tapped, the tap hole in the furnace acts quite similarly to the nozzle in the bottom of the ladle in directing the tapping stream into the ladle. This tapping stream could be directed into a metal tube suspended from the top of the ladle. Into this metal tube could be added desulfurizing slags, dephosphorizing slags, deoxidizers, sulfur removing, sulfide shape controlling elements, and other elements necessary to meet the chemical specifications and it would be expected when the stirring action of this tapping stream was confine within the tube that the desulfurizing and dephosphorizing reactions would be more effective, deoxidation would be more certain, deoxidation to lower oxygen contents and high melting point ferro alloys dissolved into the steel more effectively.

In electric furnaces and open hearth furnaces, a device similar to a single nozzle tundish would have to be installed over the tube inserted into the ladle to direct the tapping stream into the tube in the ladle.

In the foregoing specification I have set out certain preferred practices and embodiments of my invention, however, it will be understood that this invention may be otherwise practiced within the scope of the following claims.

I claim:

1. The method of pouring molten metal into a receiving receptacle comprising the steps of:

(a) pouring the metal through a generally vertical consumable metal tube extending from a pouring source to a point submerged beneath the surface of a molten pool in the receptacle beginning adjacent the bottom of said receptacle, (b) continuously consuming the end of said vertical tube submerged beneath the surface of the molten pool at a rate such as to maintain a generally uniform portion of tube end submerged in said molten pool as pouring progresses of sufficient length to provide a stirring action across substantially the full top area and to prevent the metal from flowing across the top surface as a flowing layer beginning adjacent the bottom and continuing until pouring is completed; and (c) removing the unconsumed portion of said tube when pouring into the receptacle is completed.

2. The method as claimed in claim 1 wherein the tube is a metal tube having a composition compatible with the metal being poured.

3. The method as claimed in claim 1 wherein slag forming components are added to the metal in the vertical tube.

4. The method as claimed in claim 1 wherein metal alloying ingredients are added to the metal in the vertical tube.

5. The method as claimed in claim 2 wherein slag forming components are added to the metal in the vertical tube.

6. The method as claimed in claims 2 or 3 wherein metal alloying ingredients are added to the metal in the vertical tube.

7. The method as claimed in claim 4 wherein the alloying ingredients are selected from the group consisting of aluminum, titanium, zirconium, magnesium, calcium and the rare earth metals.

8. The method as claimed in claim 3 wherein the slag composition is substantially the ternary eutectic of CaO, $Al_2O_3$ and $CaF_2$.

* * * * *